US008434970B2

(12) United States Patent
Gaudry et al.

(10) Patent No.: US 8,434,970 B2
(45) Date of Patent: May 7, 2013

(54) BREAKABLE ROCK BOLT

(75) Inventors: Timothy J. Gaudry, Picton (AU); Peter H. Craig, Cooyal (AU)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 218 days.

(21) Appl. No.: 12/444,918

(22) PCT Filed: Oct. 11, 2007

(86) PCT No.: PCT/US2007/081077

§ 371 (c)(1), (2), (4) Date: Apr. 9, 2009

(87) PCT Pub. No.: WO2008/051728

PCT Pub. Date: May 2, 2008

(65) Prior Publication Data

US 2010/0028088 A1 Feb. 4, 2010

(30) Foreign Application Priority Data

Oct. 19, 2006 (AU) ..... 2006905824

(51) Int. Cl.
*E21D 20/00* (2006.01)

(52) U.S. Cl.
USPC ..... 405/259.2

(58) Field of Classification Search ..... 405/259.1, 405/259.2; 411/2, 3, 39, 43
See application file for complete search history.

(56) References Cited

U.S. PATENT DOCUMENTS

| | | | | |
|---|---|---|---|---|
| 2,947,279 | A | 8/1960 | Hohos et al. | |
| 3,326,004 | A | 6/1967 | Williams | |
| 4,132,080 | A | 1/1979 | Hansen | |
| 4,659,267 | A * | 4/1987 | Uno et al. | 411/5 |
| 5,374,140 | A * | 12/1994 | Standish et al. | 405/259.5 |
| 5,791,823 | A | 8/1998 | Blakley et al. | |
| 2006/0078391 | A1 * | 4/2006 | Stankus et al. | 405/259.4 |
| 2007/0050965 | A1 * | 3/2007 | Gary | 29/505 |

* cited by examiner

*Primary Examiner* — David Bagnell
*Assistant Examiner* — Kyle Armstrong
(74) *Attorney, Agent, or Firm* — The Webb Law Firm

(57) ABSTRACT

A rock bolt is disclosed, which includes first and second ends, a shaft extending between the ends, the shaft incorporating a hollow metal rod including at least one breaking zone and wherein the shaft is arranged to preferentially break in the breaking zone when impact loading is applied to the shaft.

15 Claims, 5 Drawing Sheets

BREAKABLE ROCK BOLT

BACKGROUND OF THE INVENTION

1. Field of the Invention

The present invention relates to rock bolts suitable for use in the mining and tunnelling industries to provide rock and wall support. The invention is suitable for use in hard rock applications as well as in softer strata, such as that often found in coal mines, and it is to be appreciated the term "rock" as used in the specification is to be given a broad meaning to cover both these applications.

2. Description of Related Art

Roof and wall support is vital in mining and tunnelling operations. Mine and tunnel walls and roofs consist of rock strata, which must be reinforced to prevent the possibility of collapse. Rock bolts are widely used for consolidating the rock strata.

In conventional strata support systems, a bore is drilled into the rock by a drill rod, which is then removed and a rock bolt is then installed in the drilled hole and secured in place typically using a resin or cement based grout. The rock bolt is tensioned which allows consolidation of the strata by placing that strata in compression.

In some mining operations, the rock bolts are designed to be subsequently extracted by the mining equipment on extraction of the surrounding strata. These operations are common in coal mining using longwall or continuous mining operations. In these operations, large blocks of coal referred to as "panels" are accessed as ribs or walls and are extracted in a single continuous operation by mechanical cutting equipment such as longwall shearers and continuous miners. In establishing access to the panels, rock bolts are driven into the coal bed to bind the strata together and these rock bolts are subsequently extracted on extraction of the panels.

In the past, various types of rock bolts have been used in such operations. One common type of rock bolt is formed from a solid steel rod. These rock bolts exhibit very good support characteristics for the rib or wall but they have been known to tear conveyor belts or block transfer points as the extracted rock bolt is conveyed with the extracted coal. A lot of deeper mines using steel rock bolts have to modify their transfer points and place additional magnets on the conveyors to pick all the steel out of the coal. Nevertheless, many mines which are set up for steel bolts still experience downtime due to damage as a result of the extracted rock bolt.

Alternative types of rock bolts have been used to try to ameliorate this problem. This includes bolts made from other materials such as reinforced fibreglass or plastic. These bolts have the benefit that the plastic or the fibreglass will float during the normal coal washing process and as such do not contaminate the end product and typically do not damage the reinforced rubber conveyor belt used to transport the coal out of the mine. The problem with such bolts is that they typically have very low strength characteristics particularly in respect of shear and torsional strength.

SUMMARY OF THE INVENTION

According to a first aspect, the present invention provides a rock bolt comprising first and second ends, a shaft extending between the ends, the shaft incorporating a hollow metal rod including at least one breaking zone and wherein the shaft is arranged to preferentially break in the breaking zone when impact loading is applied to the shaft.

The rock bolt according to the above form is suited to applications where it is extracted on extraction of the surrounding strata. By incorporating at least one breaking zone in the shaft, the rock bolt will have a propensity to break at that zone when it is impacted by the mining equipment. This allows the rock bolt to be removed in discrete parts rather than in a single piece which is more likely to damage or block the conveyor belt system. Further, the lengths of the rock bolt can be controlled by positioning of the breaking zones and these lengths can be set to a size that allows clear passage through the conveyor belt system and a cleaner more efficient pick up by magnets if required.

In addition by forming the shaft as a hollow metal rod, the cross-sectional area of the metal rod will be significantly less as compared to a solid rod. As such, it is possible to use a higher tensile strength steel which typically exhibits less ductility. This facilitates the breaking of the rock bolt under impact loading rather than bending or deforming of the shaft under such loading. In addition, the use of a hollow metal rod lends itself to using the rock bolt in a self drilling application where the bolt also acts as the drill rod and the hollow passage allows drilling fluid and/or grout to be pumped up through the hollow core of the bolt to the drill tip of the bolt.

In one form, the at least one breaking zone is formed by profiling of the metal rod so as to create a stress concentration in the breaking zone. In one form, the rod is profiled so that it has a reduced thickness at the breaking zone as compared to other portions of the rod. In a particular form, the rod is profiled at the breaking zone to incorporate at least one groove. This groove may be continuous about the rod or alternatively the breaking zone may include a plurality of discrete grooves which extend about the periphery of the bolt. In another form, the rod is profiled to include deformations in the rod.

In an alternative form, the rod is formed in a manner where the metal property in the breaking zone is different to other portions of the rod. In this form, the change in material property creates a breaking zone which will preferentially break under impact loading. For example the metal may be post-formed by a heating and quenching operation which changes the temper of the metal so that it is less ductile in the region of the breaking zone.

In one form, the metal rod is formed from steel having a yield strength of greater than 400 Mpa. In a particular embodiment, the steel has a yield strength of approximately 500 Mpa and exhibits low to medium elongation. The rock bolt has in one form tensile strength of between 8-10 tonne and the hollow profile of the rod provides good shear resistance. Further as the tensile strength of the rod is higher than mild steel, it has low to medium ductility which increases the likelihood of breaking by impact of mining equipment such as longwall shearers and continuous miners.

In one form, the rock bolt is arranged to be anchored within the rock bore using a chemical anchoring system such as by resin bonding. To improve the transition of load from the bore hole wall to the rock bolt, in one form, the shaft of the rock bolt is profiled. In one form, the metal rod is profiled to form the weakened zone (such as through the incorporation of grooves and/or deformations) and this profiling is used also to increase the bond strength of the installed rock bolt. In another form, additional profiling is provided on the rod to increase its bond strength.

In yet another form, the shaft further incorporates a coating on the metal rod that has a lower specific gravity than the rod, such as a polymer. The polymer coating layer may provide external texturing which can help with mixing of the resin by the rock bolt in the hole. Also the coating on the rock bolt helps to fill some of the annulus formed between the bolt and the hole at a minimal increase in weight to the bolt and minimises the amount of resin that is required for bonding the bolt to the rock strata. An example of a coated bolt is disclosed in the applicant's corresponding Australian application No. 200522116511, the contents of which are herein incorporated by cross-reference.

In another form, the bolt incorporates a mechanical anchoring device adjacent its first end to allow for point anchoring of the bolt in the bore. This mechanical anchoring may be in addition or instead of the chemical anchoring mentioned above.

In one form, the first end is arranged to be disposed within the bore, whilst the second end is arranged to project from the rock strata. In a particular form, the second end is adapted to be connected to a drilling apparatus to allow the bolt to be inserted and rotated within the wall. In a particular form, the rock bolt incorporates an abutting device slideably mounted on the shaft and adapted to abut a portion of the substrate adjacent to the bore opening, and a holder mounted adjacent a proximal end of the shaft to prevent the abutting device from being removed from the shaft at its second end. In one form, the shaft comprises a threaded portion at its second end for threaded engagement with the device and/or the holder.

In a further form, the first end of the bolt incorporates a drill tip to penetrate rock so as to allow the rock bolt to be self-drilling. In this form, the rock bolt acts as both the bolt to tension the rock strata and also as the drill rod to form the bore. As such, the bore can be drilled and the bolt installed in a single pass thereby providing the opportunity to substantially improve installation times of the rock bolts. In this form, typically the shaft uses the internal passage of the hollow rod to allow drilling fluid and/or resin or grout to be introduced into the bore to effect the drilling and/or anchoring operations.

BRIEF DESCRIPTION OF THE DRAWING(S)

Embodiments of the present invention are hereinafter described with reference to the accompanying drawings. The particularity of the drawings and the related description used are to be understood as not superseding the generality of the preceding broad description of the invention.

DETAILED DESCRIPTION OF THE INVENTION

Figure 1:
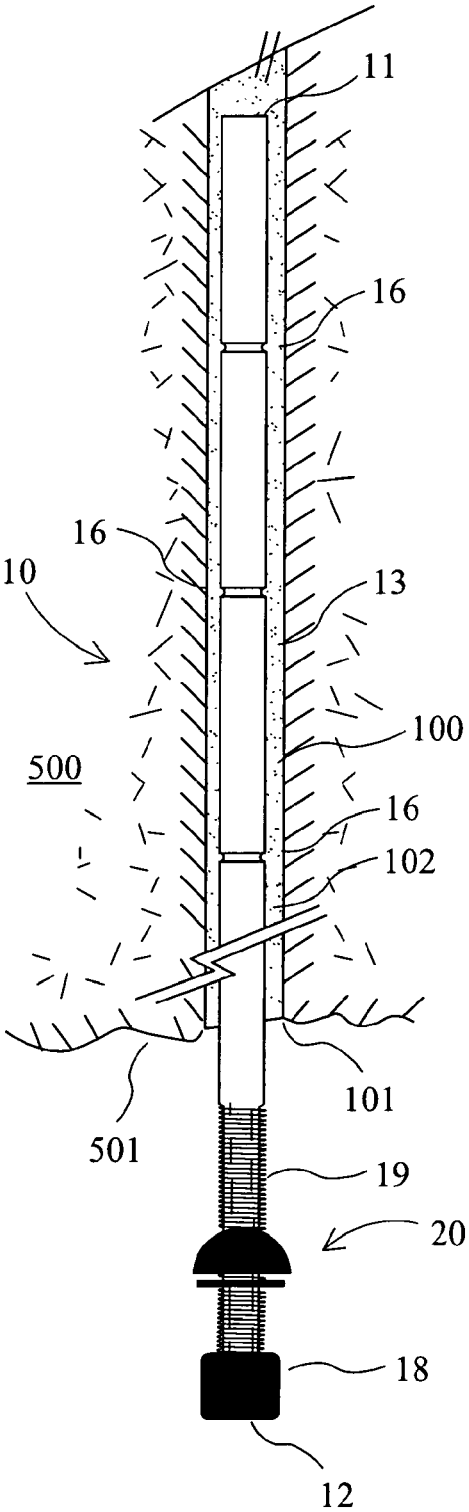
FIG. 1 is an elevation of a breakable rock bolt according to an embodiment of the invention partially inserted in a bore in rock strata.
Figure 2:
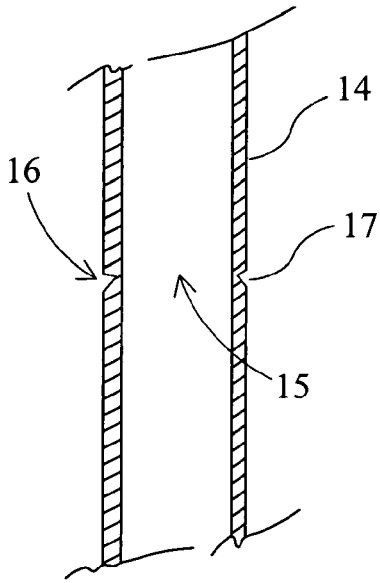
FIG. 2 is a partial sectional view to an enlarged scale of the rock bolt of FIG. 1.

Turning firstly to FIGS. 1 and 2, a rock bolt 10 is disclosed which comprises a first and second end (11, 12) respectively and a shaft 13 extending between the ends. The rock bolt is arranged to be located within a bore 100 drilled in rock strata 500 with the first end disposed within the interior of the bore whereas the second end 12 projects from an opening 101 of the bore 100.

The bolt 10 in the illustrated form is designed specifically to be used in applications where the rock bolt is arranged to be extracted after it has been installed in place as part of the extraction process of the surround strata. Such procedures are common in coal mining using longwall or continuous mining operations where large blocks of coal referred to as "panels" are accessed as ribs or walls and are extracted in a singular continuous operation by mechanical cutting equipment such as longwall shearers and continuous miners. In establishing access to the panels, rock bolts are driven into the coal bed to bind the strata together and these rock bolts are subsequently extracted on extraction of the panels.

The shaft 13 of the rock bolt 10 incorporates a hollow metal rod 14 which extends between the opposite ends 11 and 12. The metal rod 14 is preferably made from a high tensile steel having a yield strength in the order of 500 Mpa and exhibits low to medium elongation. The diameter of the rod 14 may vary depending on its application, but typically has an outer diameter in the order of 18-24 mm and in one form has a tensile strength of between 8-10 tonne with the hollow profile providing good shear resistance for the bolt. As the tensile strength of the rod 14 is higher than mild steel, it is also less ductile.

With the construction of the shaft 13 being formed from the hollow steel rod 14 a central passage 15 is disposed within the shaft which extends between the ends 11 and 12.

The shaft 13 further incorporates a plurality of spaced apart breaking zones 16 which are regions of the shaft which are designed to preferentially break when impact loading is applied to the shaft as would typically occur when the bolt is extracted from its installed position by mine cutting equipment during extraction of the surrounding strata. In the illustrated form, the breaking zones are at discrete locations along the shaft and typically having spacings in the order of 300 mm. The inventors have found that such interval lengths have the advantage that they are close enough together that impact by mining cutting equipment sufficiently close to a breaking zone to cause breaking at that zone. Further, the resulting bolt parts are typically of a size that they can pass through the conveyor belt system and are able to be separated from the extracted coal by magnets if desired.

In the illustrated arrangement of FIG. 1, the breaking zones are formed from annular grooves which are profiled into the metal rod 14. Such grooves reduce the cross-section of the rod 14 (as best illustrated in FIG. 2) to thereby increase the stress concentration at that breaking zone which provides a resultant reduction in the shear strength of the bolts.

In the illustrated form the rock bolt 10 is arranged to be installed using a chemical anchoring arrangement. In a typical chemical anchoring arrangement, a two-part resin is provided in cartridges which are inserted into the bore 100 prior to insertion of the rock bolt 10. The rock bolt is inserted sufficiently within the bore 100 so that the first end 11 contacts the cartridges. The rock bolt is then subsequently rotated which causes the cartridges to shred and allows the parts of the resin to mix. The rock bolt is further inserted to its fully installed position which causes the mixed resin to displace along at least a portion of the bore 100 to fill the gap between the shaft 13 of the bolt 10 and the bore wall 102. The resin is then left to cure to bond the bolt to the bore.

When using a chemical anchoring arrangement, the first end 11 is arranged to be closed so as to prevent resin entering the passage 15. Moreover, the second end includes a drive nut 18 which has a dual function of imparting rotation to the bolt 10 as well as allowing tightening of the bolt 10 when it is installed in position. These functions are provided by incorporating a thread 19 on the shaft 13 adjacent the second end 12. The nut 18 incorporates a complimentary thread (not shown) so as to enable the nutt 18 to be wound up the thread 19 so that it can be axially displaced along the shaft 13 of the rock bolt 10. The nut 18 incorporates a torque resisting device (not shown) typically in the form of a shear pin which extends between the nut 18 and into the shaft 13. This shear pin couples the drive nut 18 to the shaft 13 so that they are caused to rotate together under relative low levels of torque. However, under higher relative torque, the shear pin is arranged to shear thereby allowing relative rotation between the drive nut and the shaft 13 so as to enable it to actually displace along the shaft 13.

A washer 20 is disposed on the shaft and is arranged to bear either directly against the rock strata face 501 surrounding the bored hole or alternatively locate against a bearer plate which in turn locates against the bored hole. Axially displacing the drive nut 18 along the shaft 13 towards the first end causes the washer 20 to be moved into engagement against the rock strata (either directly or through the bearer plate) thereby allowing tensioning of the bolt.

Whilst one form of bolt tensioning mechanism has been shown, it is to be appreciated that the invention is not limited to such a tensioning arrangement and other tensioning arrangements may be employed as are known in the art.

Figure 3:
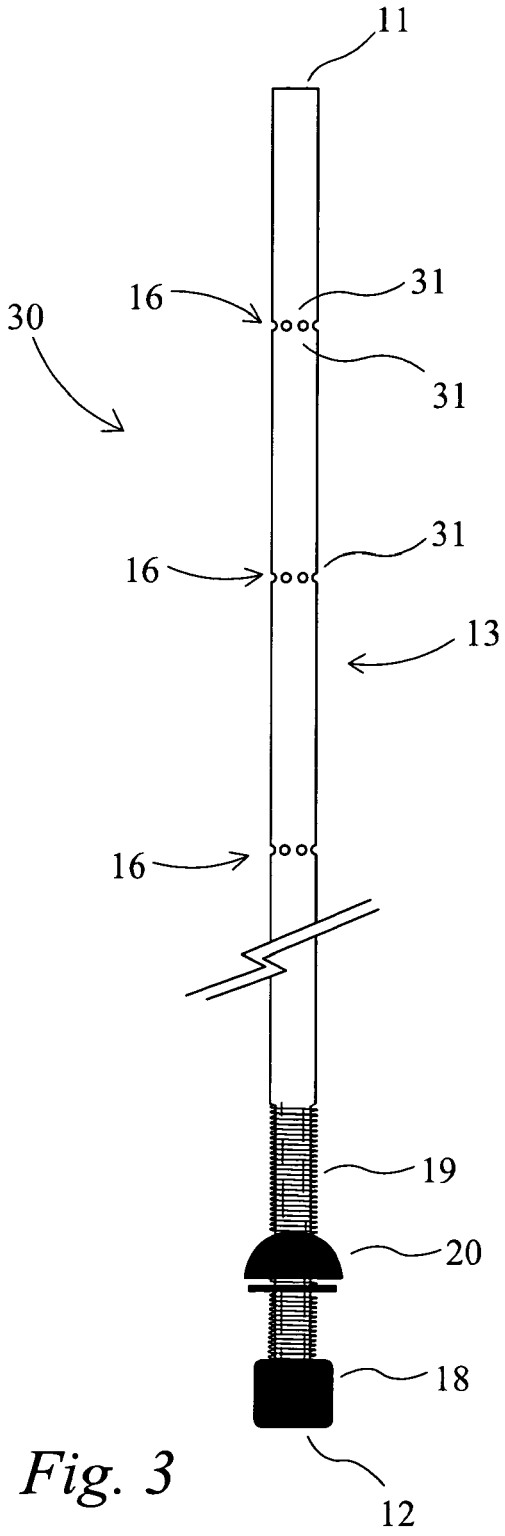
FIG. 3 is a variation of the rock bolt of FIG. 1.

FIG. 3 illustrates a rock bolt 30 which is a variation on the rock bolt 10 and for convenience like features have been given like reference numerals.

The rock bolt 30 is designed with the same basic construction as the rock bolt 10 with the exception that the breaking zones 16 formed in the shaft 13 are made up of a series of deformations 31 which are pressed into the hollow metal rod 14. These deformations are provided in groups which are spaced around the circumference with each set of groups of deformations being discretely spaced apart along the length of the shaft thereby forming the discrete breaking zones 16. In other respects, the rock bolt 30 functions in the same way as the rock bolt 10 shown in FIGS. 1 and 2.

Figure 4:
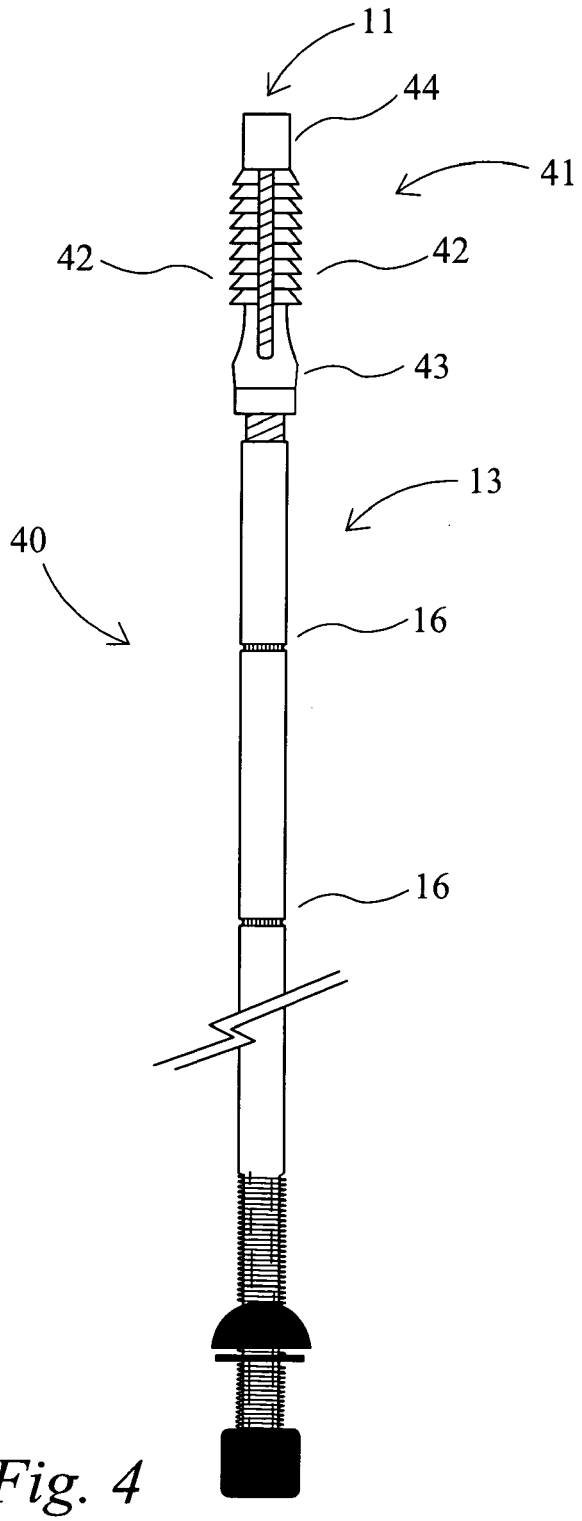
FIG. 4 is a further variation of the rock bolt of FIG. 1 which incorporates a mechanical anchor.

FIG. 4 illustrates a rock bolt 40 which is a further variation of the rock bolt 10. Again the rock bolt 40 includes many of the features of the earlier embodiment and like reference numerals have been given to like features. In the embodiment of FIG. 4, rather than the first end 11 of the bolt being plain, a mechanical point anchor device 41 is disposed adjacent the first end 11. The mechanical anchor 41 includes a pair of expansion shells 42 which are designed to hinge outwardly under a predetermined rotation of device 41 relative to the shaft 13. The mechanical anchor 41 incorporates a base portion 43 which is threadedly engaged to the shaft 13 with right hand rotation of the base portion 43 relative to the shaft causing the anchoring assembly 41 to move along the shaft, towards the first end which causes the expansion shells 42 to move apart as those shells contact a plug 44 disposed at the first end of the shaft 11.

With the mechanical anchoring system 41, the rock bolt 40 can be point anchored when installed in a drilled bore by mechanical means in addition to, or instead of using chemical anchoring as in earlier embodiments. In other respects, the bolt 40 operates in a similar manner to the earlier bolts and in particular incorporates the breaking zones 16.

Figure 5:
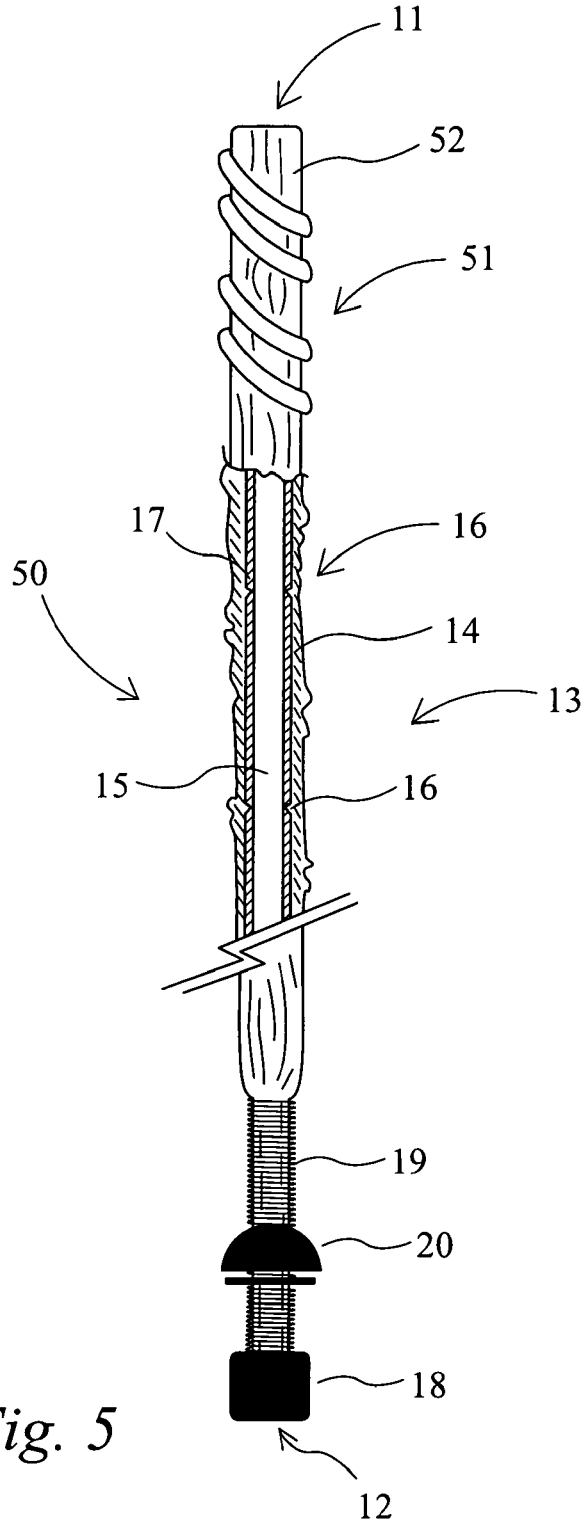
FIG. 5 is a further variation of a breakable rock bolt incorporating a polymer coating.

A further form of rock bolt 50 is disclosed in FIG. 5. Again the rock bolt incorporates many of the features of the first embodiment and like features have been given like reference numerals.

In the embodiment of FIG. 5, the shaft 13 of the rock bolt 50 incorporates a polymeric coating which is applied over the hollow shaft. As in the earlier embodiment the shaft 13 incorporates the discrete breaking zones 16 which in the illustrated form are provided by grooves 17 disposed within the metal rod 14. The purpose of the polymeric overlay 51 is to provide a profiling on the shaft 13 which encourages mixing of the resins as well as improving the bonding strength between the shaft 13 and the bore wall 102. In the illustrated form the polymeric coating incorporates a plurality of ribs 52 which extend about the shaft 13. A further advantage of using a polymeric coating 51 is that it takes up some of the void space within the bore thereby minimising the amount of resin that is required to provide an effective bond between the rock bolt 50 and the bore wall.

Figure 6:
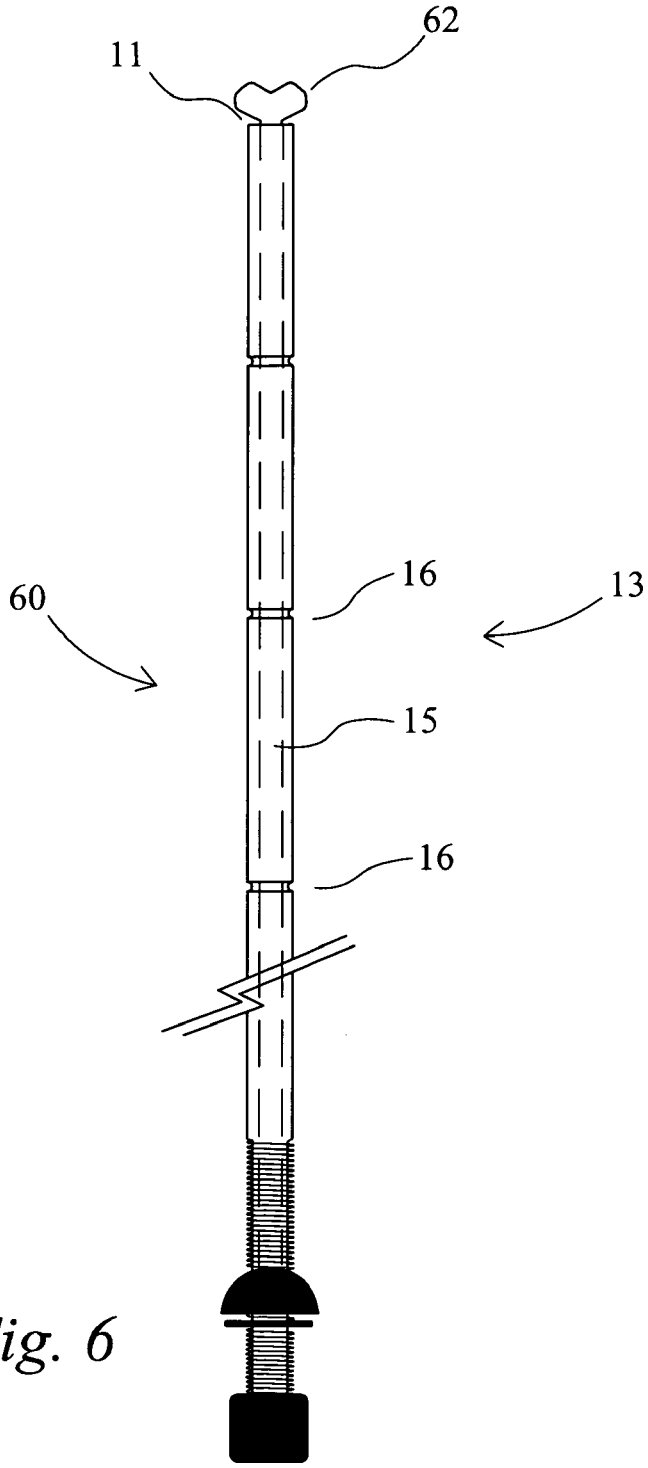
FIG. 6 is a further variation of the rock bolt of FIG. 1 which has self-drilling capabilities.

A further form of rock bolt 60 is disclosed in FIG. 6. Again, the rock bolt 60 includes many of the features of the earlier embodiment of rock bolt 10 and like features have been given like reference numerals.

In the embodiment of FIG. 6, the rock bolt 60 is modified to have "self drilling" capabilities where the rock bolt is used to both drill the bore into the rock strata and then remain in place to act as the bolt for consolidating that strata. In this arrangement, the rock bolt 60 incorporates a drill tip 61 at its first end 11 to effect drilling of the bore hole under rotation of the shaft 13. In this arrangement, the rock bolt 60 utilises the central passage 15 so as to enable drilling fluids, resin and/or grout to be introduced to the first end 11 or to be extracted from that end to assist in this drilling process.

It is to be appreciated that variations and/or modifications may be made to the parts previously described without departing from the spirit or ambit of the present invention.

The invention claimed is:

1. A rock bolt comprising:

first and second ends;

a shaft extending between the ends, the shaft incorporating a hollow metal rod including a plurality of spaced apart breaking zones; and a tensioning mechanism configured to allow tensioning of the shaft of the rock bolt, wherein the shaft is arranged to preferentially break in each of the plurality of spaced apart breaking zones when impact loading is applied to the shaft, and wherein the shaft is configured to support rock strata, and wherein the hollow metal rod is formed from high tensile steel having a yield strength greater than 400 Mpa.

2. A rock bolt according to claim 1, wherein each breaking zone is formed by profiling of the metal rod so as to create a stress concentration in the breaking zone.

3. A rock bolt according to claim 2, wherein the rod is profiled at each breaking zone to incorporate at least one groove.

4. A rock bolt according to claim 3, wherein the groove is continuous about the rod.

5. A rock bolt according to claim 2, wherein the rod is profiled at each breaking zone to incorporate a plurality of deformations.

6. A rock bolt according to claim 1, wherein the rod is of reduced thickness in each breaking zone as compared to other portions of the rod.

7. A rock bolt according to claim 1, wherein the rod has a different material property at each breaking zone as compared to other portions of the rod.

8. A rock bolt comprising:

first and second ends;

a shaft extending between the ends, the shaft incorporating a hollow metal rod including a plurality of spaced apart breaking zones; and a tensioning mechanism configured to allow tensioning of the shaft of the rock bolt, wherein the shaft is arranged to preferentially break in each of the plurality of spaced apart breaking zones when impact loading is applied to the shaft, and wherein the shaft is configured to support rock strata, and wherein the shaft further comprises a polymeric coating on said hollow metal rod.

9. A rock bolt according to claim 8, wherein the polymeric coating is profiled.

10. A rock bolt according to claim 1, further comprising a mechanical anchor disposed at or adjacent the first end.

11. A rock bolt according to claim 1, further incorporating a drill tip at said first end to enable said rock bolt to be self-drilling.

12. A rock bolt according to claim 1, wherein the bolt further incorporates an internal passage within said shaft to allow fluid to be passed between said first and second ends.

13. A rock bolt according to claim 1, wherein the second end is adapted to be connected to a drilling apparatus to allow rotation to be imparted to the rock bolt.

14. A rock bolt according to claim 1, wherein the shaft includes a threaded portion adjacent the second end, the tensioning mechanism comprising a drive nut engaged with the threaded portion and configured to be axially displaceable along the shaft.

15. A rock bolt according to claim 14, further comprising a mechanical anchor disposed at or adjacent the first end.

* * * * *

UNITED STATES PATENT AND TRADEMARK OFFICE

CERTIFICATE OF CORRECTION

PATENT NO. : 8,434,970 B2
APPLICATION NO. : 12/444918
DATED : May 7, 2013
INVENTOR(S) : Gaudry et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 220 days.

Signed and Sealed this
Eighth Day of September, 2015

Michelle K. Lee

Michelle K. Lee
*Director of the United States Patent and Trademark Office*